US006543946B2

(12) United States Patent
Hori et al.

(10) Patent No.: US 6,543,946 B2
(45) Date of Patent: Apr. 8, 2003

(54) COMBINATION PRINTER

(75) Inventors: Fumihisa Hori, San Jose, CA (US); Tsuyoshi Miyano, San Jose, CA (US); Masahiko Mori, Iwate-gun (JP)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/900,383

(22) Filed: Jul. 6, 2001

(65) Prior Publication Data

US 2003/0007821 A1 Jan. 9, 2003

(51) Int. Cl.[7] ..... B41J 2/315; B41J 2/30; B41J 1/50; B41J 5/08; B41J 11/26

(52) U.S. Cl. ..... 400/487; 400/120; 400/124.05; 400/124.08; 400/124.09; 400/149; 400/618

(58) Field of Search ..... 400/487, 120, 400/149, 618, 124.05, 124.08, 124.09, 648; 101/488

(56) References Cited

U.S. PATENT DOCUMENTS 3,808,969 A * 5/1974 Pearce ..... 101/93
5,229,788 A * 7/1993 Shimada et al. ..... 346/76
5,266,972 A * 11/1993 Gotho et al. ..... 346/76
5,459,504 A * 10/1995 Sato ..... 347/215
5,660,486 A * 8/1997 Okuda et al. ..... 400/120.07
5,708,467 A * 1/1998 Yoshikawa et al. ..... 347/213
5,790,161 A * 8/1998 Shibasaki et al. ..... 347/172
6,023,283 A * 2/2000 Imai ..... 347/212
6,037,961 A * 3/2000 Saito et al. ..... 347/185

* cited by examiner

*Primary Examiner*—Andrew H. Hirshfeld
*Assistant Examiner*—Marvin P. Crenshaw
(74) *Attorney, Agent, or Firm*—Beyer Weaver & Thomas

(57) ABSTRACT

A combination printer is described. The combination printer includes a thermal head and an ink printing head, such as a thermal transfer printing head. The thermal head thermally prints on thermal paper by heating. The thermal transfer printing head prints ink on the thermal paper by thermally transferring ink from an ink film to the thermal paper. The thermal transfer head is preferably positioned downstream relative to the first head along a paper flow path of the thermal paper. The printer further includes a first platen that serves as a back support for the thermal head, and a second platen that serves as a back support for the thermal transfer printing head.

2 Claims, 1 Drawing Sheet

COMBINATION PRINTER

BACKGROUND OF THE INVENTION

The present invention relates to printers, and more specifically, to apparatus and methods for printing on thermal paper using a thermal head.

Thermal printers are used for printing various documents including purchase receipts. The printers for the purchase receipts are used in point-of-sale (POS) and electronic cash register (ECR) stations. Today, some ECRs print images such as discount coupons on the purchase receipts with multiple colors, which attract more attention of the customers than a single color.

In the prior art, there are thermal printers that print on thermal paper in two colors (e.g., magenta and black) using two-color thermal paper. The two-color thermal paper is colored in magenta when relatively low heating energy is applied thereto, and is colored in black when relatively high heating energy is applied. However, the use of this two-color thermal paper poses some problems. For example, the cost of the two-color thermal paper is relatively high compared to mono-color thermal paper. A black dot printed on the two-color thermal paper often looks dark red or brown since the high heating energy for black color causes areas adjacent to the black dot to be heated to such an extent that the adjacent area is colored magenta. Furthermore, there is no way to print in more than two colors by using the two-color thermal paper.

In view of these and other issues, it would be desirable to have a technique allowing a thermal printer to print in two or more colors on thermal paper with high quality of images inexpensively.

SUMMARY OF THE INVENTION

According to various embodiments of the present invention, a combination printer has a direct thermal printing head and a thermal transfer printing head. The direct thermal printing head is positioned upstream relative to the thermal transfer printing head. Here, the energy necessary for the direct thermal printing is higher than the energy necessary for the thermal transfer printing. Thus, the downstream head for the thermal transfer printing does not deteriorate the printing quality by coloring thermal paper which is printed by the direct thermal printing upstream relative to the thermal transfer printing head.

In some embodiments, the printer further includes a first platen that serves as a back support for the thermal head, and a second platen that serves as a back support for the thermal transfer printing head. The first and second platens may be arranged to apply tension to the thermal paper therebetween.

In some specific embodiments, the second head is movable away from the paper flow path in a direction transverse to the thermal paper, and a transport mechanism is provided to support the thermal paper at least when the second head moves away from the paper flow path.

Still another aspect of the present invention provides a method for printing. The method includes printing on thermal paper by both heating, and printing ink on the thermal paper. In a specific embodiment, the printing ink on the thermal paper includes thermal transfer printing for transferring ink from an ink film to the thermal paper.

A further understanding of the nature and advantages of the present invention may be realized by reference to the remaining portions of the specification and the drawings.

BRIEF DESCRIPTION OF THE DRAWING

The invention, together with further objects and advantages thereof, may best be understood by reference to the following description taken in conjunction with the accompanying drawings in which.

DETAILED DESCRIPTION OF SPECIFIC EMBODIMENTS

Figure 1:
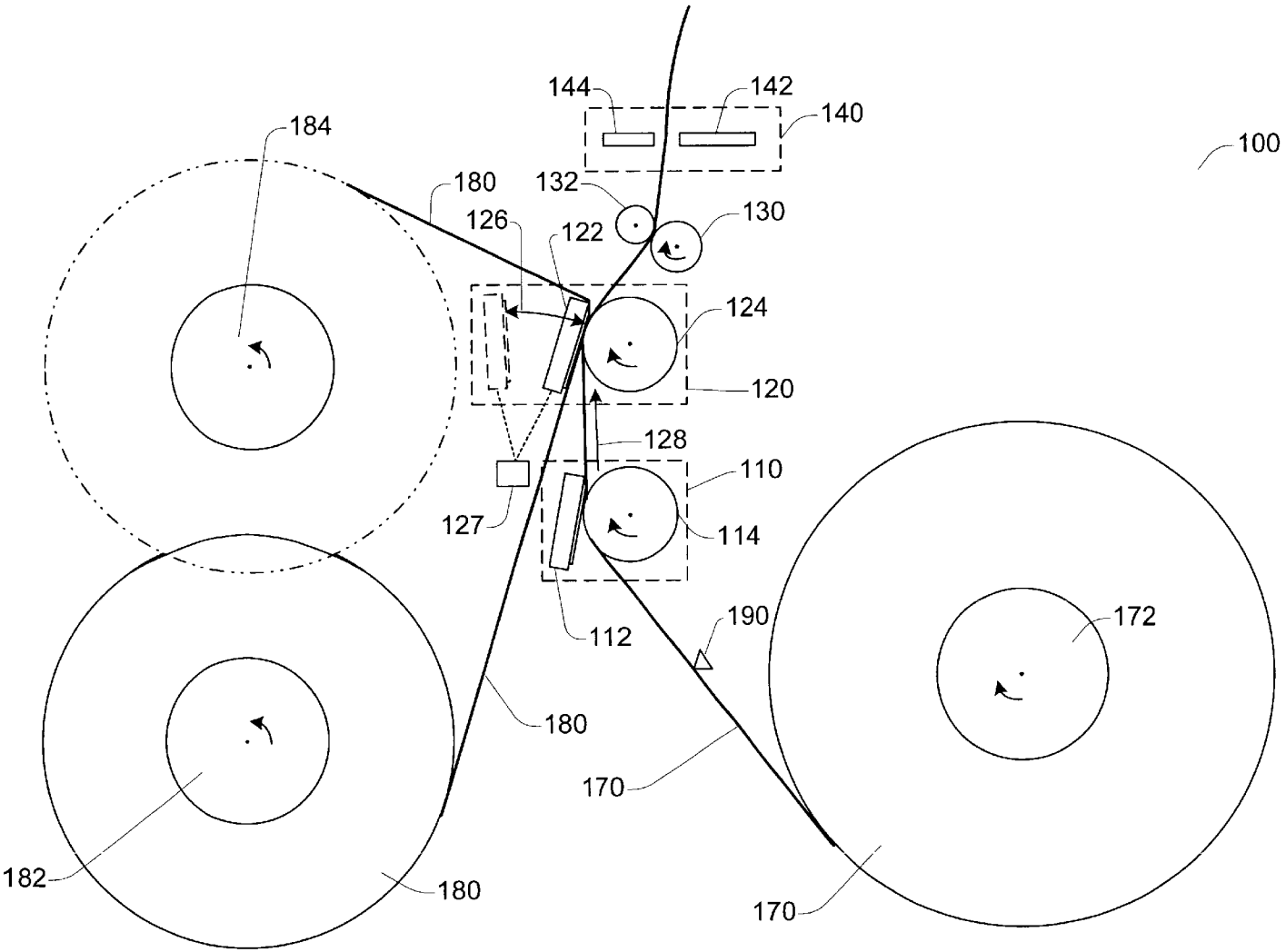
FIG. 1 is a cross-sectional view of a specific embodiment of a combination printer according to the present invention.

Various embodiments of the present invention will now be described in detail with reference to the drawings, wherein like elements are referred to with like reference labels throughout.

Various embodiments of the present invention (i) print images by adding heat directly to thermal paper ("direct thermal printing"), and then (ii) print images by applying ink on the thermal paper ("printing using ink"). In a specific embodiment, the ink printing is performed by thermally transferring ink from an ink film to the thermal paper ("thermal transfer printing").

FIG. 1 is a cross-sectional view of a specific embodiment of a combination printer 100 according to the present invention. The combination printer 100 includes a first printing section 110 having a thermal head 112 and a platen 114, and a second printing section 120 having a thermal transfer printing head 122 and a platen 124. The thermal head 112 and the platen 114 are pressed against each other so that the platen 114 actuated by a motor (not shown) advances thermal paper 170 from upstream to downstream along a paper flow path indicated by an arrow 128. In the specific embodiment, the first printing section 110 is positioned upstream along the paper flow path of the thermal paper 170 relative to the second printing section 120. Similarly, the thermal transfer printing head 122 and the platen 124 are pressed against each other so that the platen 124 actuated by a motor (not shown) advances the thermal paper 170 from upstream to downstream along the paper flow path indicated by the arrow 128.

A transport roller 130 actuated by a motor (not shown) and a roller 132 are pressed against each other so that the rollers 130 and 132 advance the thermal paper 170 further from upstream to downstream along the paper flow path indicated by the arrow 128. The roller 132 is rotatably supported without being actuated by a motor. However, in alternative embodiments, both the transport roller 130 and the roller 132 may be actuated by a motor or separated motors.

The combination printer 100 includes a cutter section 140 arranged to cut the thermal paper at desired locations. There are a wide variety of suitable paper cutters that are commercially available and any suitable cutter arrangement may be used in the cutter section 140. By way of example, in the embodiment shown, the cutter section 140 has a fixed knife edge 142 and a movable knife edge 144. The combination printer 100 includes a paper sensor 190. The paper sensor 190 detects whether the thermal paper 170 exists. The paper sensor is typically located upstream of the first printing section 110, although its precise location may be widely varied. The thermal paper 170 is wound around a core 172.

The thermal transfer printing head 122 is arranged to thermally transfer ink from an ink film 180 to the thermal paper 170. Typically, the ink film 180 includes a base film and an ink layer deposited on the base film, and is wound around a sending core 182. After the ink film 180 passes through the thermal transfer printing head 122, the ink film 180 is wound around a receiving core 184.

Now the printing operation of the specific embodiment of the present invention will be described in detail. The thermal paper 170 is transported from the core 172 to downstream along the paper flow path by a paper feeding mechanism (not shown).

When the thermal paper 170 is transported to the thermal head 112, the platen 114 presses the thermal paper 170 against the thermal head 112. While the platen 114 is continuously actuated to rotate to feed the thermal paper (clockwise in the orientation shown in FIG. 1), the thermal head 112 selectively energizes heating elements to apply heat to the thermal paper 170. The thermal paper 170 includes a thermosensitive recording layer having a thermosensitive material. The heated areas of the thermosensitive material are colored, for example, in black.

While being printed by the first printing section 110, the thermal paper 170 is further transported from upstream to downstream along the paper flow path indicated by the arrow 128, then reaching the second printing section 120. Based on the distance between the first printing section 110 and the second printing section 120, which is known, the platen 114 advances the thermal paper 170 by a predetermined distance so that the recording start point on the thermal paper 170 reaches a recording point of the second printing section 120 by controlling a rotating amount of the platen 114.

When the thermal paper 170 is transported to the thermal transfer printing head 122, the platen 124 presses the thermal paper 170 against the thermal transfer printing head 122 via the ink film 180. While the platen 124 is continuously actuated to rotate clockwise, the thermal transfer printing head 122 selectively energizes heating elements to apply heat to the thermal paper 170. The thermal transfer printing head 122 transfers the ink layer of the ink film 180 corresponding to the heated areas to the thermal paper 170. The color of the ink layer of the ink film 180 is selected from colors which are different from the color printed by the direct thermal printing using the first printing section 110. One specific color among various options for the second printing section 120 is magenta. As a result, the thermal paper 170 is printed in two different colors, for example, black and magenta in this specific embodiment.

When the thermal paper 170 is printed by the second printing section 120, the ink film 180 is unwound from the sending core 182, pulled forward by the receiving core 184 which rotates counterclockwise in FIG. 1, and then wound around the receiving core 184. In this specific embodiment, when the second printing section 120 does not print images on the thermal paper 170 by thermal transfer printing, the thermal transfer printing head 122 is actuated by an actuator 127 to be away from the paper flow path of the thermal paper 170 in a direction transverse to the thermal paper 170 indicated by an arrow 126. In such a situation, the ink film 180 is moved away from the thermal paper 170 such that the thermal paper 170 advances without advancing the ink film 180, thereby the ink film 180 is more efficiently used. This actuation of the head 122 by the actuator 127 is useful when reduction in use of the ink film 180 is an important issue. The actuator 127 and the thermal transfer printing head 122 are mechanically coupled in any suitable manner to cause the thermal transfer printing head 122 to move away from the thermal paper 170. The dotted line between the actuator 127 and the thermal transfer printing head 122 in FIG. 1 represents the mechanical coupling therebetween.

The transport roller 130 actuated by the motor (not shown) and the roller 132 pull out the thermal paper 170 toward the cutter section 140. The rollers 130 and 132 supports the thermal paper 170 when the thermal transfer printing head 122 moves away from the paper flow path, thus stabilizing the transportation of the thermal paper 170.

In the specific embodiment, the diameter of the platen 124 is larger than that of the platen 114, thereby making the paper transport speed at the second printing section 120 larger than that at the first printing section 110. Thus, the platens 114 and 124 apply tension to the thermal paper 170 therebetween, resulting in no slack. It will be understood that other suitable mechanisms for applying tension to the thermal paper 170 can be utilized instead of using platens having different diameters.

The rollers 130 and 132 transports the thermal paper 170 to the cutter section 140. The rollers 130 and 132 are positioned relative to the head 122 and the platen 124 so that the rollers 130 and 132 press the thermal paper 170 against the platen 124 even when the head 122 is actuated to be away from the paper flow path. The printed portion of the thermal paper 170 is cut by the fixed knife edge 142 and the movable knife edge 144 at a desirable position.

As described above, in the specific embodiment of the present invention, first, the first printing section 110 performs the direct thermal printing using the thermal head 112 for an area on the thermal paper 170, and then, the second printing section 120 performs the thermal transfer printing using the thermal transfer printing head 122 for the area, thereby enabling two-color printing. In other words, the first printing section 110 is positioned upstream along the paper flow path of the thermal paper 170 indicated by the arrow 128 relative to the second printing section 120. This structure of the printing sections 110 and 120 according to the specific embodiment of the invention is advantageous here. In the specific embodiment where the heat energy needed by the thermal transfer printing head 122 for transferring the ink from the ink film 180 to the thermal paper 170 is about 80% of the heat energy needed by the thermal head 112 for direct thermal printing by heating the thermosensitive layer of the thermal paper 170, i.e., the heat energy for the thermal transfer printing by the thermal head 122 is lower than the heat energy for the direct thermal printing by the thermal head 112, the thermal transfer printing process at the second printing section 120 colors the thermal paper 170 only by the thermal transfer printing, not by direct thermal printing. Specifically, a peripheral portion of the areas to be colored by the second printing section 120 is not colored by direct thermal printing (e.g., is not colored in black), but is colored purely by the thermal transfer printing (e.g., is colored purely in magenta), thereby improving the quality of the two-color printing.

The total heat energy per unit time needed by the thermal transfer printing head 122 is governed by various parameters including thermosensitivity of the ink layer of the ink film 180, the thickness of a base film of the ink film 180, total heating duration of the head 122 per unit time, and the like. In the above-described specific embodiment of the present invention, the heat energy needed by the thermal transfer printing head 122 is set about 80% of the heat energy needed by the thermal head 112 by selecting suitable parameters, and the heating by the head 122 is controlled accordingly.

The above-described structure in which the direct thermal printing section (i.e., the first printing section 110) is positioned upstream relative to the thermal transfer printing section (i.e., the second printing section 120) is capable of (i) keeping the head 112 clean since the thermal head 112 is upstream relative to the thermal transfer printing head 122, thereby avoiding melting the ink layer on the thermal paper 170 transferred by the thermal transfer printing head 122, and (ii) printing with high quality without coloring the thermosensitive layer of the thermal paper 170 when the thermal transfer printing head 122 prints images.

The specific embodiment of the present invention enables printing in multiple colors using thermal heads, thereby providing gradation colors, which are suitable for, for example, various kinds of purchase receipts, coupons, and the like. Furthermore, by actuating the head 122 in the transverse direction to the thermal paper 170 depending on whether the head 122 needs to perform printing, the specific embodiment of the invention is capable of printing alphanumeric characters by the first printing section 110 in monochrome, and graphical images by the first and second printing sections 110 and 120 in quasi-continuous gradation colors, thereby producing attractive printed materials, while reducing the consumption amount of the ink film 180.

The above-described specific embodiment uses the first printing section 110 which prints images on the thermal paper 170 in black. Those skilled in the art will appreciate that the color printed by the first printing section 110 may be any other color suitable for the thermal paper 170.

In the above-described specific embodiment, the thermal transfer printing method using the thermal transfer printing head 122 is utilized for the "printing using ink." However it should be understood that other suitable methods can be used as the printing using ink for the second printing section 120. For example, the thermal transfer printing head 122 can be replaced by an ink jet head for ejecting ink droplets onto the paper. Alternatively, bubble jets, laser jets or any other ink printing mechanism may be provided.

The specific embodiment used for, for example, ECR or POS systems described above prints images in black using the head 112 for the direct thermal printing, and prints images in magenta using the head 122 for the thermal transfer printing as the printing method using ink. However, the colors used for these printing methods may be other colors suitable for the printing mechanisms. Also, the second printing section 120 may print images in a plurality of colors. For example, instead of a single-color ink film, the second printing section 120 may utilize a multiple-color ink film and a thermal head suitable for multi-color thermal transfer printing. Similarly, if multi-color thermal paper is used, the thermal head 112 can be arranged to generate multiple colors as well, thereby further diversifying the number of colors available.

Although only a few embodiments of the present invention have been described in detail, it should be understood that the present invention may be embodied in many other specific forms without departing from the spirit or scope of the invention. For example, the illustrated embodiments have been described primarily in the context of an ECR system, it should be appreciated that various printers or devices including a printer may include the direct thermal printing mechanism and the ink printing mechanism. Therefore, it should be apparent that the above described embodiments are to be considered as illustrative and not restrictive, and the invention is not to be limited to the details given herein, but may be modified within the scope of the appended claims.

What is claimed is:

1. A combination printer comprising:

a first printing unit having a first thermal head for thermally printing on thermal paper, and a first platen which is disposed in such a manner that the first platen opposes the first thermal head and the first platen and the first thermal head can be pressed against each other;

a second printing unit having a second thermal head which is positioned downstream along a paper flow path of the thermal paper relative to the first printing unit, and which transfers ink from an ink film to the thermal paper, and a second platen which is disposed in such a manner that the second platen opposes the second thermal head and the second platen and the second thermal head is able to come into contact with and come away from the second platen;

a feed roller which is positioned downstream along the paper flow path of the thermal paper relative to the second printing unit; and a cutter member which is positioned downstream along the paper flow path of the thermal paper relative to the feed roller, wherein the diameter of the second platen is made larger than the diameter of the first platen, thereby making the transport speed of the thermal paper by the second platen higher than the transport speed of the thermal paper by the first platen, so that tension is applied to the thermal paper between the first thermal head and the second thermal head and slack in the thermal paper is prevented, and wherein the thermal paper is cut by the cutter member after printing.

2. A combination printer according to claim 1, wherein driving energy applied for transferring ink from the ink film to the thermal paper by the second thermal head is smaller than driving energy applied for direct thermal printing on the thermal paper by the first thermal head so that direct thermal printing on the thermal paper does not occur.

* * * * *